US011095073B2

(12) United States Patent
Spilker et al.

(10) Patent No.: US 11,095,073 B2
(45) Date of Patent: Aug. 17, 2021

(54) LOCKING CLIP

(71) Applicant: HARTING Electric GmbH & Co. KG, Espelkamp (DE)

(72) Inventors: Nicole Spilker, Lübbecke (DE); Heiko Herbrechtsmeier, Bünde (DE); Sebastian Griepenstroh, Lübbecke (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/621,329

(22) PCT Filed: Aug. 7, 2018

(86) PCT No.: PCT/DE2018/100692

§ 371 (c)(1),
(2) Date: Dec. 11, 2019

(87) PCT Pub. No.: WO2019/037814

PCT Pub. Date: Feb. 28, 2019

(65) Prior Publication Data

US 2020/0119492 A1 Apr. 16, 2020

(30) Foreign Application Priority Data

Aug. 21, 2017 (DE) ..... 10 2017 119 057.0

(51) Int. Cl.
*H01R 13/629* (2006.01)
*H01R 13/639* (2006.01)

(52) U.S. Cl.
CPC ..... *H01R 13/62955* (2013.01); *H01R 13/639* (2013.01)

(58) Field of Classification Search
CPC ..... H01R 13/62955; H01R 13/639; H01R 13/62938; H01R 13/5219
See application file for complete search history.

(56) References Cited

U.S. PATENT DOCUMENTS 5,628,642 A 5/1997 Bieringer et al.
5,954,528 A * 9/1999 Ono ..... H01R 13/62972 439/152

(Continued)

FOREIGN PATENT DOCUMENTS

CN 101562299 A 10/2009
CN 104505660 A 4/2015

(Continued)

*Primary Examiner* — Jean F Duverne
(74) *Attorney, Agent, or Firm* — Smartpat PLC

(57) ABSTRACT

A locking clip for plug housings has a rear wall and side parts formed on the rear wall. The locking clip has a U-shaped cross-section. The side parts each have a mounting receptacle, by which the locking device can be pivotably mounted on the plug housing. The locking device has an embossment directed toward the plug housing in the region of each mounting receptacle. Thus, the locking device is not supported on the plug body over the full surface, and therefore a lower-wear locking operation is ensured. A system includes a first plug housing and a second plug housing and a locking clip. The locking clip is pivotably mounted on the first plug housing by mounting pins. The locking clip can be locked on the second plug housing on locking pins. The locking clip touches the plug housings only at the mounting pins and at the locking pins.

11 Claims, 3 Drawing Sheets

(56) References Cited

U.S. PATENT DOCUMENTS

| | | | | |
|---|---|---|---|---|
| 6,540,431 | B1 * | 4/2003 | Okabe | H01R 13/62938 403/322.4 |
| 6,863,463 | B2 * | 3/2005 | Matsushita | F16B 21/10 403/322.4 |
| 7,241,155 | B2 * | 7/2007 | Tyler | H01R 13/62938 439/157 |
| 7,361,036 | B2 * | 4/2008 | Pittenger | H01R 13/62977 439/157 |
| 10,439,325 | B2 * | 10/2019 | Kritter | H01R 13/62938 |
| 2005/0026484 | A1 * | 2/2005 | Demuth | H01R 13/6295 439/157 |
| 2009/0258530 | A1 | 10/2009 | Nehm | |
| 2012/0115346 | A1 * | 5/2012 | Zwanger | H01R 13/5219 439/310 |
| 2016/0226186 | A1 | 8/2016 | Griepenstroh | |

FOREIGN PATENT DOCUMENTS

| | | | |
|---|---|---|---|
| CN | 106911043 | A | 6/2017 |
| CN | 105659444 | B | 4/2018 |
| DE | 2915574 | A1 | 10/1980 |
| DE | 4241256 | C2 | 6/1994 |
| DE | 19830182 | A1 | 1/2000 |
| DE | 202004004619 | U1 | 5/2004 |
| DE | 102004061046 | | 2/2007 |
| EP | 0971455 | A3 | 11/2000 |
| EP | 2451021 | A2 | 5/2012 |
| EP | 2961005 | A1 | 12/2015 |

* cited by examiner

LOCKING CLIP

TECHNICAL FIELD

The disclosure relates to a locking clip for reversibly locking two plug connectors or plug connector housings which are plugged together. The disclosure also relates to a system consisting of a first plug connector housing and a second plug connector housing and such a locking clip.

BACKGROUND

DE 29 15 574 A1 shows a locking clip for reversibly locking a first plug connector housing to a second plug connector housing. The locking clip is manufactured from a spring-elastic wire.

DE 10 2004 061 046 B4 shows a locking clip which is stamped out of a sheet-metal piece and produces a resilient locking between two plug connector housings.

Both of the abovementioned locking clips are pivotably mounted on a housing of a plug connector. The locking clips have a locking receptacle, which grip over a locking pin of a second plug connector housing, whereby the first plug connector housing and the second plug connector housing are pressed against one another in a resilient manner. The two plug connector housings are then locked together. During the locking operation, the plug connector housings and the locking pins are subject to heavy wear, since the locking devices rub against the plug connector housings and in particular against the bearing pin thereof during the pivoting operation. The reliability of the locking mechanism therefore decreases with a certain number of locking cycles.

SUMMARY

A reliable locking clip which guarantees wear-resistant locking of two plug connector housings is presented. The locking clip may also be referred to as a locking device.

The locking device is provided for locking together two plug connector housings. The locking device substantially consists of a rear wall and side parts which are molded thereon, wherein the locking clip thus has a U-shaped cross section. The side parts each have a bearing receptacle. The bearing receptacle is usually configured as a circular opening. The bearing receptacle grips over a bearing pin of a plug connector housing, which bearing pin matches the bearing receptacle. The locking device can be pivotably mounted on the plug connector housing by way of the bearing receptacle. In the region of the respective bearing receptacle, the locking device has an embossment which is directed toward the plug connector housing.

The total area of the locking device is therefore not supported on the plug connector body, as a result of which a more wear-resistant locking operation is guaranteed.

Due to the respective embossment in the region of the bearing receptacles, the locking device can be permanently spaced apart from the plug connector housing, as a result of which less physical contact occurs during the pivoting operation. As a result, the locking device can be more easily operated. At the same time, there is less wear on the housing due to abrasion during the locking operation.

The locking device consists of a rear wall with side parts which are molded therein. The locking device has a U-shaped cross section. The side parts have bearing receptacles via which the locking device is pivotably mounted on a first plug connector housing. The side parts have locking receptacles which can grip over locking pins on a second plug connector housing.

The locking device is preferably made as a one-piece component. The locking device is advantageously manufactured from an elastic material and can be produced, for example, using a stamping and bending method. Production methods of this type are particularly cost-effective.

The locking device is usually used in a system comprising a first plug connector housing and a second plug connector housing. The locking device is fixed to the first plug connector housing in a pivotable manner via bearing pins here. During a pivoting operation, the locking device can pivot over or be fixed on locking pins which are molded on the second plug connector housing. As a result, the first plug connector housing and the second plug connector housing can be reversibly locked together. The essence of the invention consists in the locking device being in physical contact with the respective plug connector housings only in the region of the bearing pins and the locking pins. The locking device does not rub against the rest of the housing body. A particularly wear-resistant locking operation can thus be established.

The plug connector housings advantageously consist of plastics. Plug connector housings of this type can be produced in a very cost-effective manner. However, plug connector housings of this type are very fragile if they are scratched by metallic components. In this case, not only are the esthetics of the plug connector housing altered, but its functionality is also at risk.

The abovementioned bearing pins and/or the locking pins preferably have a cylindrical basic form with a prismatic contour molded thereon. The prismatic contour preferably has a triangular cross section here. Such a contour can be very easily provided in the production process of the plug connector housings, preferably an injection molding process. This means that no additional expenses are incurred in the production process.

The prismatic contour serves to support the locking device on the first and on the second plug connector housing in the locked state. The side parts of the locking device are substantially spaced apart from the plug connector housings. The spacing can be adjusted from a few tenths of a millimeter up to 3 mm. The rear wall is also not in physical contact with the plug connector housings.

Preferably, the bearing pins and the locking pins and the contours which are molded thereon respectively project perpendicularly from the respective plug connector housing along their axis of symmetry. The bearing pins and the locking pins are in each case longer than the respective contours. This means that the locking receptacle of the locking device can grip over the locking pins and is supported by the shorter contour, for example. The contour prevents the locking clip from grinding along the plug connector housing during the locking process and from leaning against the plug connector housing during the locked state.

The locking device, in the region of the respective bearing receptacle, has an embossment which is directed toward the plug connector housing. The embossment of the locking device is supported on the contour of the bearing pin in the locked state. In the unlocked state, the locking device is expanded by the interaction of the embossment and the contour during the locking process. The locking device is also initially expanded during the unlocking operation by the contour while pivoting away. The locking operation and the unlocking operation can thus in each case be carried out in a wear-resistant manner.

DETAILED DESCRIPTION

The figures partly comprise simplified, schematic depictions. Identical reference numbers are used, in part, for similar but possibly not identical elements. Different views of the same elements could be scaled differently.

Figure 1:
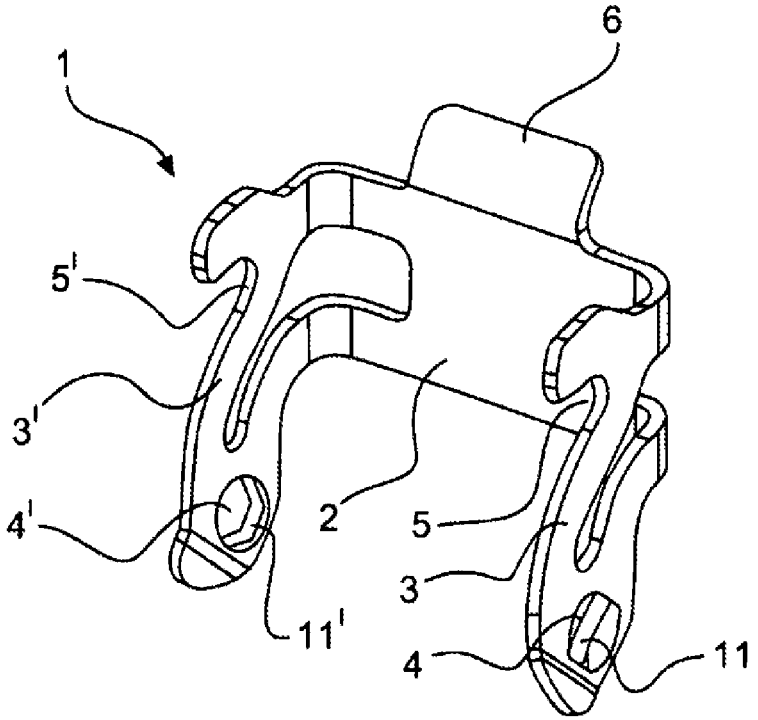
FIG. 1 shows a perspective depiction of a locking device.

FIG. 1 shows a perspective depiction of an example of a locking device 1. The locking device consists of a rear wall 2 and two side parts 3, 3' molded thereon. The locking device 1 has a substantially U-shaped cross section. An opening is incorporated in the lower region of the side parts 3, 3' respectively, which openings each serve as a bearing receptacle 4, 4'. In the upper region, the side parts 3, 3' each have a recess, which recesses each function as a locking receptacle 5, 5'. An actuating means 6, which is bent back from the rear wall 2, is molded on the rear wall 2 in the upper region. This actuating means 6 can be used by an operator to apply force during the pivoting operation.

Figure 2:
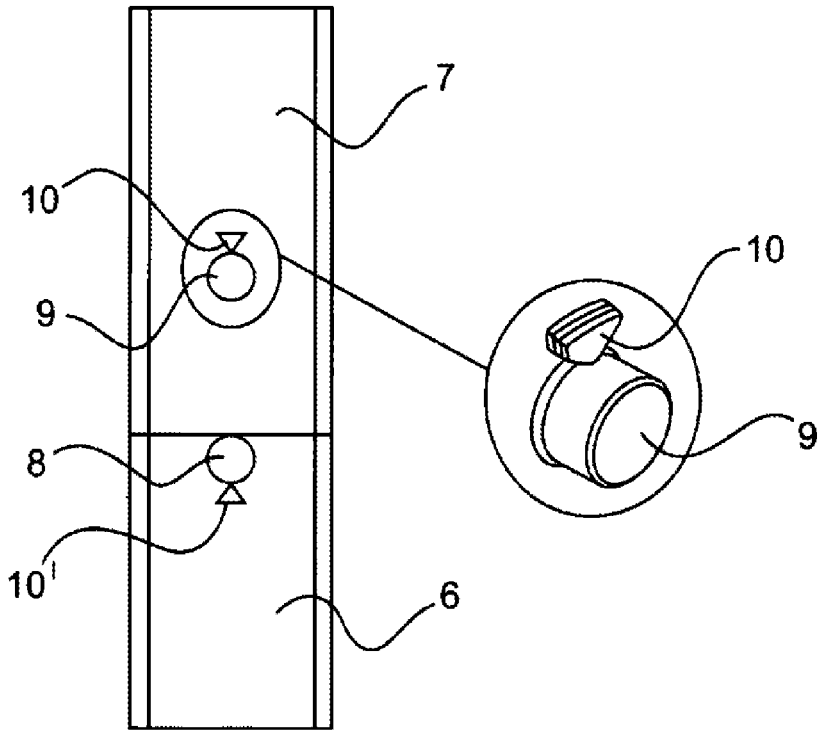
FIG. 2 shows a side view of a first plug connector housing and a second plug connector housing in the plugged state.
Figure 3:
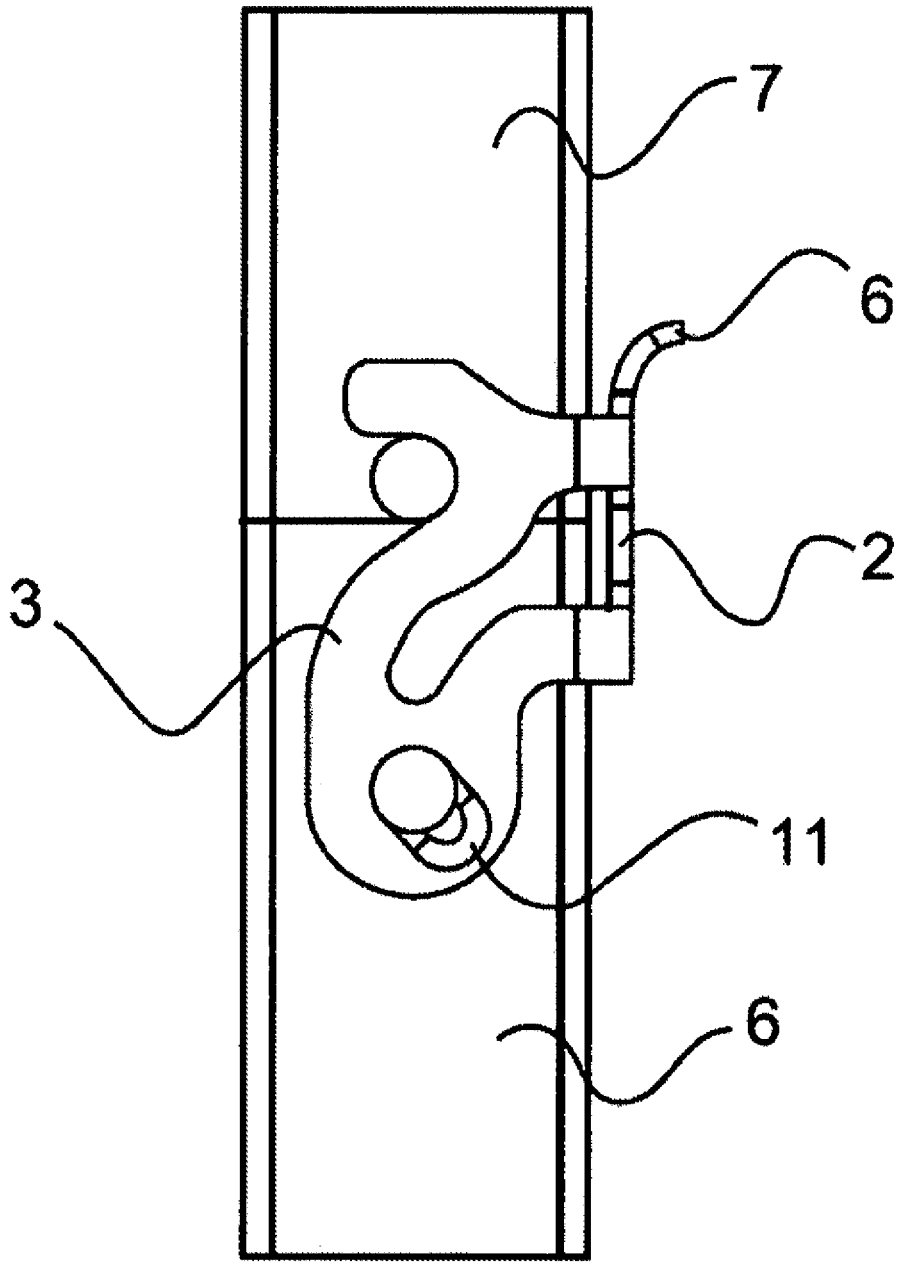
FIG. 3 shows a side view of a first plug connector housing and a second plug connector housing in the plugged state with a locking clip.
Figure 4:
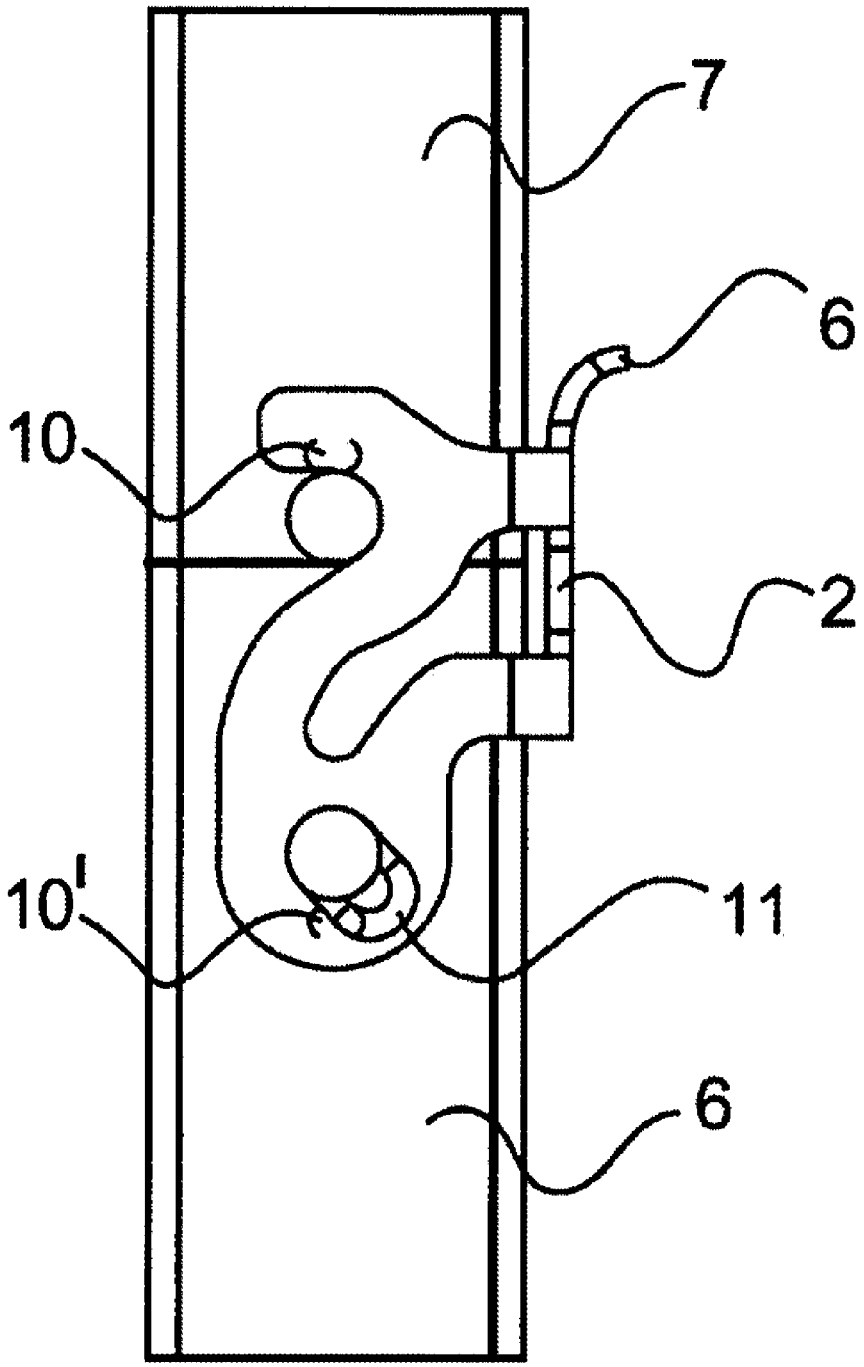
FIG. 4 shows a side view of a first plug connector housing and a second plug connector housing in the plugged state with a transparent locking clip.

FIG. 2 shows a side view of a first plug connector housing 6 plug-connected to a second plug connector housing 7. The bearing receptacles 4, 4' of the locking device 1 can grip over the bearing pins 8 of the first plug connector housing 6. The locking device 1 is therefore pivotably mounted on the first plug connector housing 6. Locking pins 9 are molded on the narrow sides of the two plug connector housings 7. FIGS. 3 and 4 show how the locking receptacles 5, 5' of the locking clip 1 grip over the locking pins 9 of the second plug connector housing 7 in the locked state. The first and the second plug connector housings 6, 7 are thus reversibly locked together.

A prismatic contour 10 is molded on the bearing receptacles 8 and the locking pins 9 respectively. In order to depict the contour 10 accurately, the locking pin 9 of the second plug connector housing 7 is magnified in the right-hand part of FIG. 2. The contour 10 is prismatic and possesses a triangular cross section along its axis of symmetry. The bearing pins 8 and the locking pins 9 are longer than the respective contour 10, 10'. This means that the bearing pins 8 and the locking pins 9 project perpendicularly further away from the plug connector housing than the respective contour 10.

In the region of the bearing receptacles 4, 4', the locking device 1 in each case has an embossment 11, 11' which is directed inwardly. The locking device 1 is elastically expanded during the locking operation by means of the embossments 11, 11' and the contours 10, 10' molded on the bearing pins 8. The locking device 1 does not rub against the plug connector housings 6, 7 with its side parts 3, 3'. Moreover, the respective locking receptacle 5, 5' does not rub against the plug connector housings 6, 7. A resistance during the final locking is clearly noticeable to the operator.

The locking clip 1 is held in place in the locked state by way of the shape of the contours 10, 10' and the corresponding embossments 11, 11'. During the unlocking operation, a resistance must again be overcome since the locking device 1 is once more elastically expanded. An accidental opening of the system is hence ruled out. Moreover, the locking device 1 does not rub against the plug connector housings 6, 7 with its side parts 3, 3'. Likewise, the respective locking receptacle 5, 5' does not rub against the plug connector housings 6, 7.

In the case of the locking device 1, the side parts 3, 3' can have play in the region between a locking receptacle 5, 5' and the corresponding locking pin 9, so that the locking receptacle 5, 5' does not rub over the surface of the locking pins 9 in the locked state.

LIST OF REFERENCE NUMBERS

1 Locking device
2 Rear wall
3 Side part
4 Bearing receptacle
5 Locking receptacle
6 First plug connector housing
7 Second plug connector housing
8 Bearing pin
9 Locking pin
10 Contour
11 Embossment

The invention claimed is:

1. A system, comprising:

a first plug connector housing;

a second plug connector housing; and a locking clip pivotably mounted on the first plug connector housing via bearing pins, the locking clip comprising a rear wall; and side parts which are molded onto the rear wall, wherein the locking clip has a U-shaped cross section, wherein the side parts each have a circumferentially closed bearing receptacle by way of which the locking clip is pivotably mounted on the first plug connector housing, wherein the side parts each comprise an outwardly bent portion adjacent to the circumferentially closed bearing receptacle, wherein the locking clip, in a region of the respective bearing receptacle, has an embossment which is directed toward the first plug connector housing, wherein the locking clip can be locked on locking pins on the second plug connector housing, whereby the first plug connector housing and the second plug connector housing are locked together, wherein the locking clip is in physical contact with the plug connector housings only in a region of the bearing pins and in a region of the locking pins, wherein the bearing pins and/or the locking pins have a cylindrical basic form with a prismatic contour molded thereon, wherein the bearing pins and the locking pins and the prismatic contours which are molded thereon respectively project perpendicularly from the plug connector housings, and wherein the bearing pins and the locking pins are longer than the respective prismatic contours.

2. The system claimed in claim 1, wherein the plug connector housings consist of plastics or metal.

3. The system as claimed in claim 1, wherein the prismatic contour has a triangular cross section.

4. The system as claimed in claim 1, wherein the bearing receptacles of the locking clip grip over the bearing pins of the first plug connector housing, and wherein the embossment of the locking clip is supported on the prismatic contour of the bearing pin in a locked state.

5. The system as claimed in claim 1, wherein the locking clip has locking receptacles which grip over the locking pins of the second plug connector housing, and wherein the side parts of the locking clip are each supported on the prismatic contour of the locking pin in a locked state.

6. The system as claimed in claim 1, wherein the embossment of the locking clip and the prismatic contour of the bearing pin cooperate to expand the locking clip during unlocking.

7. The system as claimed in claim 1, wherein the rear wall is arranged parallel to a longitudinal extension of the first plug connector housing and the second plug connector housing when the locking clip is locked.

8. The system as claimed in claim 1, wherein the prismatic contour is arranged on a side of the bearing pin facing away from the second plug connector housing.

9. A system, comprising:

a first plug connector housing;

a second plug connector housing; and a locking clip pivotably mounted on the first plug connector housing via bearing pins, the locking clip comprising a rear wall and side parts which are molded onto the rear wall, wherein the locking clip has a U-shaped cross section, wherein the side parts each have a circumferentially closed bearing receptacle by way of which the locking clip is pivotably mounted on the first plug connector housing, wherein the side parts each comprise an outwardly bent portion adjacent to the circumferentially closed bearing receptacle, wherein the locking clip, in a region of the respective bearing receptacle, has an embossment which is directed toward the first plug connector housing, wherein the locking clip can be locked on locking pins on the second plug connector housing, whereby the first plug connector housing and the second plug connector housing are locked together, wherein the locking clip is in physical contact with the plug connector housings only in a region of the bearing pins and in a region of the locking pins, wherein the bearing pins have a cylindrical basic form with a prismatic contour molded thereon, wherein the bearing receptacles of the locking clip grip over the bearing pins of the first plug connector housing, and wherein the embossment of the locking clip is supported on the prismatic contour of the bearing pin in a locked state.

10. A system, comprising:

a first plug connector housing;

a second plug connector housing; and a locking clip pivotably mounted on the first plug connector housing via bearing pins, the locking clip comprising a rear wall and side parts which are molded onto the rear wall, wherein the locking clip has a U-shaped cross section, wherein the side parts each have a circumferentially closed bearing receptacle by way of which the locking clip is pivotably mounted on the first plug connector housing, wherein the side parts each comprise an outwardly bent portion adjacent to the circumferentially closed bearing receptacle, wherein the locking clip, in a region of the respective bearing receptacle, has an embossment which is directed toward the first plug connector housing, wherein the locking clip can be locked on locking pins on the second plug connector housing, whereby the first plug connector housing and the second plug connector housing are locked together, wherein the locking clip is in physical contact with the plug connector housings only in a region of the bearing pins and in a region of the locking pins, wherein the locking pins have a cylindrical basic form with a prismatic contour molded thereon, wherein the locking clip has locking receptacles which grip over the locking pins of the second plug connector housing, and wherein the side parts of the locking clip are each supported on the prismatic contour of the locking pin in a locked state.

11. A system, comprising:

a first plug connector housing;

a second plug connector housing; and a locking clip pivotably mounted on the first plug connector housing via bearing pins, the locking clip comprising a rear wall and side parts which are molded onto the rear wall, wherein the locking clip has a U-shaped cross section, wherein the side parts each have a circumferentially closed bearing receptacle by way of which the locking clip is pivotably mounted on the first plug connector housing, wherein the side parts each comprise an outwardly bent portion adjacent to the circumferentially closed bearing receptacle, wherein the locking clip, in a region of the respective bearing receptacle, has an embossment which is directed toward the first plug connector housing, wherein the locking clip can be locked on locking pins on the second plug connector housing, whereby the first plug connector housing and the second plug connector housing are locked together, wherein the locking clip is in physical contact with the plug connector housings only in a region of the bearing pins and in a region of the locking pins, wherein the bearing pins have a cylindrical basic form with a prismatic contour molded thereon, wherein the embossment of the locking clip and the prismatic contour of the bearing pin cooperate to expand the locking clip during unlocking.

* * * * *